US006127314A

United States Patent [19]

Ohga et al.

[11] Patent Number: 6,127,314

[45] Date of Patent: Oct. 3, 2000

[54] HEAT-SENSITIVE RECORDING MATERIAL

[75] Inventors: Kunihiko Ohga; Makoto Ono; Yoshihito Hodosawa, all of Shizuoka-ken, Japan

[73] Assignee: Fuji Photo Film Co., Ltd., Kanagawa, Japan

[21] Appl. No.: 09/083,036

[22] Filed: May 22, 1998

[30] Foreign Application Priority Data

Aug. 29, 1997 [JP] Japan ..... 9-234008

[51] Int. Cl.[7] ..... B41M 5/30

[52] U.S. Cl. ..... 503/207; 503/204; 503/214; 503/215; 503/216; 503/221

[58] Field of Search ..... 503/200, 204, 503/216, 226, 214, 207, 215, 221

[56] References Cited

U.S. PATENT DOCUMENTS

| | | | |
|---|---|---|---|
| 4,840,933 | 6/1989 | Usami et al. | 503/213 |
| 4,857,501 | 8/1989 | Usami et al. | 503/200 |
| 4,861,748 | 8/1989 | Saeki et al. | 502/208 |
| 4,999,333 | 3/1991 | Usami et al. | 503/209 |
| 5,380,693 | 1/1995 | Goto | 503/200 |

FOREIGN PATENT DOCUMENTS

| | | | |
|---|---|---|---|
| 0 273 752 | 7/1988 | European Pat. Off. | 503/213 |
| 6-336080 | 12/1994 | Japan . | |

*Primary Examiner*—Bruce H. Hess
*Attorney, Agent, or Firm*—Sughrue, Mion, Zinn, Macpeak & Seas, PLLC

[57] ABSTRACT

The present invention provides a recording material comprising a substrate, a heat-sensitive layer formed on the substrate by a coating liquid containing (1) microcapsules containing a colorless or light-colored electron-donative dye precursor and (2) a dispersion of solids comprising color developers, and a protective layer formed on the heat-sensitive layer, wherein the dispersion of solids comprising color developers is a dispersion prepared by co-dispersing at least three color developers including at least one solid color developer, preferably a water-soluble color developer, in the form of solid particles and at least one amorphous color developer together with a water-soluble polymer, and wherein the solid particles of the color developers contained in the dispersion have particle diameters in the range of from 0.3 to 0.5 $\mu$m and the haze of the heat-sensitive recording material is 55% or less.

8 Claims, No Drawings

HEAT-SENSITIVE RECORDING MATERIAL

BACKGROUND OF THE INVENTION

1. Field of the Invention

The present invention relates to a heat-sensitive recording material, and more particularly relates to a transparent heat-sensitive recording material which has a highly transparent heat-sensitive layer comprising solid particles of relatively large particle diameter dispersed therein and which has a high color forming sensitivity.

2. Description of the Related Art

A heat-sensitive recording method has various advantages, such as (1) it requires no developing process, (2) the recording material is almost the same as plain paper if the substrate is paper, (3) handling is easy, (4) the color-developing density is high, (5) the recording apparatus is simple and inexpensive, and (6) no noise is generated when recording is performed. Accordingly, its use is now rapidly spreading in the field of facsimiles and printers, and the scope of application of heat-sensitive recording is also widening in the labeling field, such as POS. Recently, because of this background, in order to meet the requirements of multicoloration or for use in an overhead projector (hereinafter abbreviated as "OHP"), a transparent heat-sensitive recording material capable of directly recording by means of a thermal head was developed. An example of the recent development is a transparent heat-sensitive recording material comprising a substrate and a layer formed thereon by a process comprising the steps of coating the substrate with a coating liquid comprising a dispersion prepared by emulsifying microcapsules, which contain a colorless or a light-colored electron donating dye precursor, and a color developer dissolved in an organic solvent, which is sparingly soluble or insoluble in water, and drying the resulting coating (see, for example, Japanese Patent Application Laid-Open (JP-A) Nos. 63-45,084 and 63-265,682). However, it has become evident that this type of transparent heat-sensitive recording material has the drawback that the unused recording material has poor storage stability and that the density of the color-developing portion changes markedly with the passage of time.

Generally, since the transparency of a transparent heat-sensitive recording material can be secured by the prevention of light scattering in the recording layer, measures hitherto employed have included, for example, reducing the particle diameter of insoluble particles such as the particles of a color developer and increasing the proportion of a binder in order to prevent the change in refractive index due to void formation in the recording layer.

For the prevention of light scattering, the particle diameter is generally required to be less than 0.2 $\mu$m, because the opacity caused by light scattering can be visually observed if a particle diameter is 0.3 $\mu$m or more. However, the use of fine particles having diameters of less than 0.2 $\mu$m is associated with problems in handling, for example, difficulty in dispersing these particles uniformly in a coating liquid to form a recording layer, and also problems such as decreased transparency due to the formation of large crystals in the coating layer because the heat generated by dispersing the fine particles causes re-flocculation of the particles. An additional problem is that although the transparency is improved by increasing the proportion of binder, the increase in the proportion of binder leads to a remarkable decrease in the sensitivity.

As described above, hitherto, a heat-sensitive recording material having excellent properties, such as high sensitivity, required for a heat-sensitive recording material along with a high level of transparency has not been achieved.

SUMMARY OF THE INVENTION

The object of the present invention is to provide a transparent heat-sensitive recording material having a heat-sensitive layer which comprises solid particles of relatively large particle diameter and which has excellent sensitivity along with excellent transparency.

After intense studies in order to solve the above-mentioned problems, the present inventors have achieved the present invention based on the discovery that a heat-sensitive recording material having superior transparency and excellent color forming sensitivity can be obtained by using specific solid particles in the heat-sensitive layer of the heat-sensitive recording material. That is, the present invention provides a transparent heat-sensitive recording material which has at least one heat-sensitive layer formed by a coating liquid containing an electron donative dye precursor desirably included inside microcapsules and a color developer together with at least one protective layer supported by a substrate, wherein the solid particles contained in the heat-sensitive layer have particle diameters in the range of from 0.3 to 0.5 $\mu$m and the haze of the heat-sensitive recording material is 55% or less.

In the heat-sensitive recording material, it is desirable that the solid particles be particles of a color developer and that the heat-sensitive layer contain 3 types of color developers with at least one of the color developers being a water-soluble color developer, and at least one of the other color developers being a color developer having amorphous characteristics. More specifically, it is desirable that the water-soluble color developer be a compound represented by the following general formula (I) and the color developer having amorphous characteristics be a compound represented by the following general formula (II).

General formula (I):

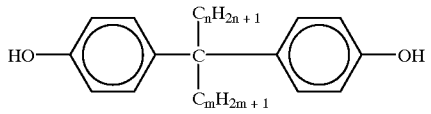

where m is an integer of 0 to 2 and n is an integer of 2 to 11.

General formula (II):

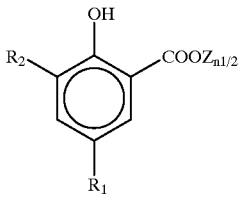

where $R_1$ and $R_2$ each represent an alkyl group having 1 to 10 carbon atoms or a group given below where $R_3$ represents a hydrogen atom or a methyl group.

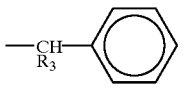

The heat-sensitive layer contains a water-soluble polymer which is desirably at least one substance selected from the group consisting of partially saponified polyvinyl alcohol and gelatin.

Since the haze of the heat-sensitive recording material, which has a heat-sensitive layer containing solid particles of relatively large particle diameters, is 55% or less, it is apparent that the heat-sensitive recording material has superior transparency.

Although the operating mechanism of attaining the superior transparency by a preferred mode which employs a combination of at least 3 types of color developers is not clear, it is supposed that part of the water-soluble color developer is solubilized and performs the same function as a binder by coating the solid particles of the insoluble color developer so that the voids on the solid particles are filled with the solubilized color developer, while the color developer having amorphous characteristics prevents the deposition of crystals in an effective way. Presumably, this interaction between these color developers makes it possible to protect the coating film from becoming heterogeneous due to, for example, crystallization induced by external factors such as heating in a dispersion apparatus in the dispersion process followed by a decrease in temperature in a stock tank, leading to the transparency and stability of the liquid comprising dispersed solid color developers being able to be secured.

DETAILED DESCRIPTION OF THE PREFERRED EMBODIMENTS

The details of the present invention are described below. The heat-sensitive recording material of the present invention comprises a heat-sensitive layer, which contains an electron donative dye precursor and a color developer, along with a protective layer supported by a substrate, wherein the electron donative dye precursor is desirably included inside microcapsules from the standpoint of stability and the color developer is desirably contained as a dispersion of solid particles in a coating liquid.

The solid particles contained in the heat-sensitive layer have particle diameters in the range of from 0.3 to 0.5 μm and are desirably a developer in the form of the solid particles. Preferably, the heat-sensitive layer contains a dispersion of solid particles composed of the developer and a water-soluble polymer.

The diameters of the solid particles contained in the heat-sensitive layer are in the range of from 0.3 to 0.5 μm. If the diameters of the solid particles are less than 0.3 μm, the predictable disadvantages are, for example, poor stability of the dispersion, decrease in dispersing efficiency due to a longer time required for the dispersing process and difficulty in the inhibition of fogging. On the other hand, if the diameters of the solid particles are more than 0.5 μm, the transparency of the heat-sensitive layer decreases.

Details of the color developer contained in the heat-sensitive layer are given below. Preferably, the heat-sensitive layer of the present invention contains solid particles which have particle diameters in the range of from 0.3 to 0.5 μm and which are color developers and a water-soluble polymer. More preferably, the heat-sensitive layer contains 3 types of color developers with at least one of the color developers being a water-soluble color developer and at least one of the other color developers being an amorphous color developer. The another type of color developer which is also contained in the heat-sensitive layer may be a known color developer as exemplified by bisphenol, monophenol and the like.

Of these color developers, if the water-soluble color developer is absent, the heat-sensitive layer is liable to produce voids which impair the transparency, and, if the color developer having amorphous characteristics is absent, the coating liquid to form the heat-sensitive layer becomes unstable and crystals tend to deposit in the coating film. If another type of color developer is also used, the stability of the liquid comprising the dispersed color developers is improved. Therefore, it is particularly desirable that the heat-sensitive layer contain 3 or more types of the color developers.

The term "water-soluble color developer" in the heat-sensitive recording material of the present invention means a color developer having a water solubility of 0.01% by weight or more and is preferably a compound represented by the general formula (I).

The term "color developer having amorphous characteristics" in the heat-sensitive recording material of the present invention means a color developer having no definite melting point and is preferably a compound represented by the general formula (II).

The color developer which is used in combination with these color developers may be appropriately selected from known color developers. Examples of this type of color developer include a phenol compound, a triphenylmethane-based compound, a sulfur-containing phenol-based compound, a carboxylic acid-based compound, a derivative of salicylic acid, a sulfone-based compound, a urea-based compound and a thiourea-based compound. The details are described in, for example, "Paper and Pulp Technical Times" (1985), pp.49–54,65–70. Among these developers, particularly preferred are those having a melting point in the range of from 50° C. to 250° C. specifically phenols, such as bisphenol and monophenol, and organic acids which have a melting point in the range of from 60° C. to 200° C. and which are sparingly soluble in water. The use of a combination of two or more developers is desirable because such a combination can enhance solubility.

Nonlimiting specific examples of the color developer are a 4,4'-(m-phenylenediisopropylidene)diphenol, 4,4'-(p-phenylenediisopropylidene)diphenol, 2-ethylhexyl 4-hydroxybenzoate, n-butyl bis(4-hydroxyphenyl)acetate, 4-[[4-(1-methylethoxy)phenyl]phosphonyl]phenol, and benzyl p-oxybenzoate.

As for the content of these color developers, the content of the water-soluble color developer is preferably 0.2 to 30% by weight based on the total weight of the color developers, and the content of the color developer having amorphous characteristics is preferably 0.2 to 30% by weight based on the total weight of the color developers. From the standpoint of balance between the transparency and the sensitivity, the weight ratio of the water-soluble color developer to the color developer having amorphous characteristics is in the range of from 60/40 to 40/60, and more preferably about 50/50.

Next, a colorless or lightly-colored electron donative dye precursor, which produces a colored substance when brought into contact with the color developers and which is included inside a microcapsule, is described below. The electron donative dye precursor for use in the present invention is appropriately selected from colorless or lightly-colored known compounds which donate electrons or accept protons of acids and the like to develop a color. These compounds have a partial structure, such as lactone, lactam, spiropyran, ester, or amide. When these compounds are brought into contact with a color developer, the above-mentioned partial structure undergoes a ring-opening or cleavage reaction. Preferred examples of these compounds include triarylmethane based compounds, diphenylmethane based compounds, xanthene based compounds, thiazine based compounds and spiropyran based compounds. Particularly preferable compounds are represented by the following general formula (III).

General formula (III):

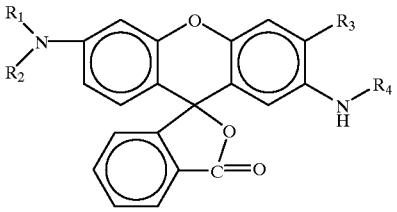

where $R_1$ represents an alkyl group having 1 to 8 carbon atoms; $R_2$ represents an alkyl or alkoxy group having 4 to 18 carbon atoms or a tetrahydrofurfuryl group; $R_3$ represents a hydrogen atom, an alkyl group having 1 to 15 carbon atoms or a halogen atom; and $R_4$ represents a substituted or unsubstituted aryl group having 6 to 20 carbon atoms. Preferable substituents of $R_4$ include an alkyl, alkoxy, or alkyl halide group having 1 to 5 carbon atoms, and a halogen atom.

In the present invention, the fogging at the time when a heat-sensitive recording material is produced can be prevented and the storage stability before use of the unused heat-sensitive recording material can be improved by including the electron donative dye precursor inside a microcapsule. In this case, the density of image at the time when recording is performed can be increased by selecting the material to form the wall and the manufacturing procedure of the microcapsule. The amount of the electron donating dye precursor for use in the heat-sensitive recording material is preferably in the range of from 0.05 to 5.0 g/m$^2$.

Examples of the material to form the wall of the microcapsule include polyurethane, polyurea, polyamide, polyester, polycarbonate, urea/formaldehyde resins, melamine resins, polystyrene, styrene/methacrylate copolymers, gelatin, polyvinylpyrrolidone, and polyvinyl alcohol. In the present invention, a combination of two or more of these polymers may be used.

In the present invention, polyurethane, polyurea, polyamide, polyester, and polycarbonate are preferred materials for the wall. Particularly preferred materials are polyurethane and polyurea.

A preferred process for making the microcapsule comprises emulsifying a core substance containing a reactive substance such as an electron donative dye precursor, and then forming a wall consisting of a polymeric material to encapsulate the oil drop, wherein a reactant, which forms the polymeric material, is added to the inside/and or outside of the oil drop. Details of a preferable process for making the microcapsule for use in the present invention are described in, for example, Japanese Patent Application Laid-Open (JP-A) No. 59-222,716. Further, a microcapsule which is essentially free of an organic solvent and which is described in JP-A No. 4-101,885 can also be used.

The organic solvent to be used for the formation of the oil drop may be selected from the substances which are generally used as pressure-sensitive oils. Examples of preferred oils include esters, oils represented by the following general formulas (IV) to (VI), triarylmethane (e.g., tritoluylmethane and toluyldiphenylmethane), a terphenyl compound (e.g., terphenyl), an alkylated diphenyl ether (e.g., propyldiphenyl ether), a hydrogenated terphenyl (e.g., hexahydroterphenyl), diphenyl ether, and chlorinated paraffin.

General formula (IV):

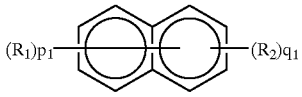

where $R_1$ represents a hydrogen atom or an alkyl group having 1 to 18 carbon atoms, and $R_2$ represents an alkyl group having 1 to 18 carbon atoms. $P_1$ and $q_1$ are each an integer of 1 to 4 with the proviso that the total number of the alkyl groups does not exceed 4. Preferably, the $R_1$ and $R_2$ alkyl groups are each an alkyl group having 1 to 8 carbon atoms.

General formula (V):

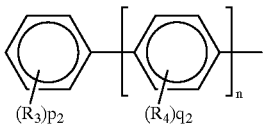

where $R_3$ represents a hydrogen atom or an alkyl group having 1 to 12 carbon atoms, and $R_4$ represents an alkyl group having 1 to 12 carbon atoms. n is 1 or 2. $P_2$ and $q_2$ are each an integer of 1 to 4, with the proviso that the total number of the alkyl groups does not exceed 4 where n is 1, and that the total number of the alkyl groups does not exceed 6 where n is 2.

General formula (VI):

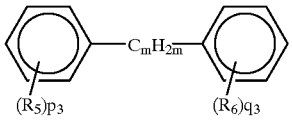

where $R_5$ and $R_6$ are a hydrogen atom or the same or different alkyl groups having 1 to 18 carbon atoms. m is an integer of 1 to 13. $p_3$ and $q_3$ are each an integer of 1 to 3, with the proviso that the total number of the alkyl groups does not exceed 3. Preferably, the $R_5$ and $R_6$ alkyl groups are each an alkyl group having 2 to 4 carbon atoms.

Examples of the compounds represented by the formula (IV) include dimethylnaphthalene, diethylnaphthalene, and diisopropylnaphthalene. Examples of the compounds represented by the formula (V) include dimethylbiphenyl, diethylbiphenyl, diisopropylbiphenyl, and diisobutylbiphenyl. Examples of the compounds represented by the formula (VI) include 1-methyl-dimethylphenyl-1-phenylmethane, 1-ethyl-dimethylphenyl-1-phenylmethane and 1-propyl-dimethylphenyl-1-phenylmethane. A combination of these oils or a combination of any of these oils and other oil may also be used.

In the present invention, the size of the microcapsule, which is expressed as a volume average particle size according to the measuring method described in, for example, JP-A No. 60-214,990, is preferably 4 $\mu$m or less.

Unlike the microcapsules which are employed in a conventional recording material and which are destroyed by heat or pressure, the preferred microcapsule, which is produced in the above-described way, enables the reactive substances present outside and inside the microcapsule to pass through the wall of the microcapsule to cause a reaction.

In the present invention, an intermediate color from among a plurality of colors can be produced by selecting the materials for the walls and by using, where necessary, a glass transition point adjusting agent (e.g., a plasticizer as described in JP-A No. 61-277,490) to prepare microcapsules composed of walls having different glass transition points while selecting combinations of electron donating dye precursors for different hues and color developers. Accordingly, the present invention is not limited to a single-color heat-sensitive recording material but can also be used for a heat-sensitive recording material which is suitable to 2-color or multicolor-recording. Further, if necessary, a light-fading inhibitor can also be added as described in JP-A Nos. 61-283,589, 61-283,590 and 61-283,591.

As for the proportion between the amounts of the electron donative dye precursor and the color developer, 0.3 to 160 parts by weight, preferably 0.3 to 80 parts by weight, of the color developer (in total) is generally used based on one part by weight of the electron donative dye precursor.

The preparation of a dispersion of color developer is carried out by a known process, that is, the dispersing operation is carried out by a process comprising the steps of adding the powder of the color developer to a water phase containing a surfactant, a water-soluble polymer, or the like as a protective colloid and dispersing the powder by means of a mixer or a grinding machine such as a ball mill, an attritor or a sand mill.

The water-soluble polymer which is present as a protective colloid in the water phase may be appropriately selected from the group consisting of known anionic polymers, nonionic polymers, and amphoteric polymers. Preferred examples of the water-soluble polymer include polyvinyl alcohol, gelatin and cellulose derivatives. The surfactant, which is present in the water phase, may be selected from the group consisting of anionic surfactants, nonionic surfactants and amphoteric surfactants, provided that the selected surfactant does not react with the protective colloid to cause precipitation or coagulation. Preferred examples of the surfactant include sodium alkylbenzenesulfonate (e.g., sodium dodecylbenzenesulfonate), sodium alkyl sulfate, sodium dioctyl sulfosuccinate, and polyalkyl glycol (e.g., polyoxyethylene nonylphenyl ether).

A melting point depressing agent for the color developer may be added to the dispersion of solids (developer). Part of the melting point depressing agent also acts as a glass transition point adjusting agent for the wall of the microcapsule. Examples of such compounds include a hydroxy compound, a carbamic acid ester compound, a sulfoneamide compound, and an aryl methoxide compound. Details of these compounds are described in, for example, JP-A No. 59-244,190. The proportion of the melting point depressing agent may range from 0.1 to 2 parts by weight, and preferably from 0.5 to 1 part by weight, based on one part by weight of the color developer whose melting point is to be depressed. It is desirable that the melting point depressing agent and the color developer whose melting point is to be depressed by the melting point depressing agent be used in the same place. If the melting point depressing agent and the color developer whose melting point is to be depressed are used in different places, the desirable added amount of the melting point depressing agent is 1 to 3 times the proportion indicated above.

In order to coat the heat-sensitive recording material of the present invention on a substrate, the heat-sensitive recording material may contain a suitable binder. The binder may be an emulsion based on such material as polyvinyl alcohol, methyl cellulose, carboxymethyl cellulose, hydroxypropyl cellulose, gum arabic, gelatin, polyvinylpyrrolidone, casein, a styrene/butadiene latex, an acrylonitrile/butadiene latex, polyvinyl acetate, polyacrylate, or an ethylene/vinyl acetate copolymer. The coated weight of the binder based on solids is in the range of from 0.5 to 5 g/m$^2$. The coated weight of the heat-sensitive recording layer is preferably in the range of from 2.5 to 25 g/m$^2$.

The heat-sensitive recording material of the present invention has a protective layer on the heat-sensitive layer. Examples of the polymer which is used in the protective layer include water-soluble polymers such as methyl cellulose, carboxymethyl cellulose, hydroxymethyl cellulose, starch, gelatin, gum arabic, casein, a hydrolyzate of a styrene/maleic anhydride copolymer, a hydrolyzate of a half ester of styrene/maleic anhydride copolymer, polyvinyl alcohol, carboxy-modified polyvinyl alcohol, a derivative of polyacrylamide, polyvinylpyrrolidone, a sodium polystyrene sulfonate, and sodium alginate as well as water-insoluble polymers such as a styrene/butadiene rubber latex, an acrylonitrile/butadiene rubber latex, a methyl acrylate/butadiene rubber latex, and a polyvinyl acetate emulsion.

To ensure compatibility of a thermal head with the protective layer during the thermal recording operation, prevention of sticking, and improvement of the water resistance of the protective layer, the protective layer may contain additives such as a pigment, a metal soap, a wax, and a cross-linking agent.

Examples of the pigment include zinc oxide, calcium carbonate, barium sulfate, titanium oxide, lithopone, talc, pyrophyllite, kaolin, aluminum hydroxide, amorphous silica, and colloidal silica. The added amount of the pigment is 0.005 to 3 times, preferably 0.01 to 1.5 times, the total weight of the polymer.

Examples of the metal soap include an emulsion of a metal salt of a higher fatty acid such as zinc stearate, calcium stearate, and aluminum stearate. The added amount of the metal soap is in the range of from 0.5 to 30% by weight, preferably in the range of from 1 to 10% by weight, based on the total weight of the protective layer.

The wax for use in the present invention has a melting point in the range of from 40 to 60° C. Examples of the wax include paraffin wax, polyethylene wax, and microcrystalline wax. The added amount of the wax is in the range of from 0.5 to 40% by weight, preferably in the range of from 1 to 20% by weight, based on the total weight of the protective layer.

Further, in order to form the protective layer uniformly on the heat-sensitive layer, a surfactant is incorporated into a coating liquid to form the protective layer. Examples of the surfactant include an alkali metal salt of a compound based on sulfosuccinic acid and a fluorine-containing surfactant. Specific examples are a sodium or ammonium salt of di-(2-ethylhexyl) sulfosuccinate or di-(n-hexyl) sulfosuccinate.

In addition, for the purpose of inhibiting the electrostatic charge of the heat-sensitive recording material, the protective layer may contain an additive such as a surfactant or a polymeric electrolyte. The coated weight of the protective layer based on solids is preferably in the range of from 0.2 to 5 g/m$^2$, and more preferably in the range of from 1 to 3 g/m$^2$.

When preparing the heat-sensitive recording material of the present invention, firstly a coating liquid is prepared by using an emulsified dispersion, which is composed of microcapsules including therein an electron donative dye precursor and at least a color developer, along with a binder and other additives. Then, a substrate, such as paper or a synthetic resin film, is coated with the coating liquid by, for example, bar-coating, blade-coating, air knife-coating, gravure-coating, roll-coating, and dip-coating, and the resulting layer is dried. The heat-sensitive layer of the heat-sensitive recording material prepared in the above-described procedure has a for superior level of transparency.

According to the purposes and uses of the heat-sensitive recording material of the present invention, a transparent substrate or an opaque substrate such as paper is used. A transparent substrate is selected in order to prepare a transparent heat-sensitive recording material which is an objective of the present invention. Use of the transparent substrate enables the recording obtained by a heat-sensitive recording process to be used not only as an OHP sheet or the like but also as a transparent image on a illuminating table. Also, a multicolor image can be obtained by coating the two sides of a substrate with heat-sensitive layers capable of forming a color different from each other. The term "transparent substrate" as used herein means a film of polyester, such as polyethylene terephthalate or polybutylene terephthalate, a film of a cellulose derivative, such as cellulose triacetate, a polystyrene film, a film of polyolefin such as polypropylene or polyethylene, and the like. These substrates may be used singly or may be laminated. The thickness of the transparent substrate is in the range of from 20 to 200 $\mu$m and preferably in the range of from 50 to 100 $\mu$m.

In order to improve the adhesion between the transparent substrate and the heat-sensitive layer, a primer layer may be provided between the substrate and the heat-sensitive layer. Examples of the material constituting the primer layer include gelatin, synthetic polymer latex, and nitrocellulose. The coated weight of the primer layer is preferably in the range of from 0.1 to 2.0 g/m$^2$ and most preferably in the range of from 0.1 to 1.0 g/m$^2$. If the coated weight is less than 0.1 g/m$^2$, the adhesion between the substrate and the heat-sensitive layer is insufficient, whereas a coated weight of more than 2.0 g/m$^2$ brings about no further improvement in the adhesion and therefore is uneconomical. When the primer layer is overcoated with a liquid to form a heat-sensitive layer, the water contained in the coating liquid can cause the primer layer to swell to an extent that the quality of image to be recorded in the heat-sensitive layer will be impaired. Therefore, it is desirable that the primer layer be hardened by use of a film hardening agent. Further, in so far as the properties of the heat-sensitive layer are not impaired, additives such as a surfactant, an antistatic agent, and an antifoaming agent may be added to the primer, if necessary.

Prior to the application of the primer, it is desirable to activate the surface of the substrate by a known pre-treatment method. Examples of the pre-treatment include an etching treatment by means of an acid, a flame treatment, by means of a gas burner, a corona discharge treatment, and a glow discharge treatment. Because of its inexpensiveness and the simplicity of the treatment, the most preferred is a corona discharge treatment, which is described in U.S. Pat. Nos. 2,715,075, 2,846,727, 3,549,406 and 3,590,107.

According to the present invention, the above-described substantially transparent heat-sensitive layer needs to be formed on at least one side of the substrate. Therefore, according to uses and purposes, the heat-sensitive recording material of the present invention can find a variety of modes such as a mode wherein the heat-sensitive layer is formed on one side of a transparent or opaque substrate, a mode wherein heat-sensitive layers capable of forming a color different from each other are formed respectively on two sides of a transparent substrate, and a mode wherein the heat-sensitive layer is laminated to a known heat-sensitive layer.

As an indicator of the transparency of the transparent heat-sensitive recording material of the present invention, a haze value is used. That is, the haze of the heat-sensitive recording material of the present invention, which comprises a transparent or opaque substrate, a substantially transparent heat-sensitive layer of the present invention formed on the substrate, and a protective layer formed on the heat-sensitive layer, needs to be 55% or less. The haze in the present invention can be measured by means of a known haze meter such as a haze meter manufactured by Suga Test Instruments Co., Ltd. The transparency of the heat-sensitive layer can be evaluated by measuring the haze of the heat-sensitive layer formed on a transparent substrate.

If the haze exceeds 55%, the level of transparency becomes too low to meet the purpose of the present invention.

EXAMPLES

The following examples are intended to illustrate but not limit the invention.

Example 1

Preparation of a Capsule Liquid 14 g of 2-anilino-3-methyl-6-N-ethyl-N-sec-butylaminofluoran and 10 g of Takenate D-110N (manufactured by Takeda Chemical Industries, Ltd.) were dissolved in 20 g of ethyl acetate. The resulting solution was admixed with 112 g of a 6% by weight aqueous solution of polyvinyl alcohol (PVA217E manufactured by Kuraray Co., Ltd.), and thereafter the mixture was emulsified at a revolution of 8,000 rpm for 5 minutes by means of an Ace Homogenizer (manufactured by Nippon Seiki Co., Ltd.). The emulsion thus obtained was admixed with 142 g of water and 0.6 g of tetraethylenepentamine, and thereafter allowed to react for 3 hours at 50° C. In this way, a capsule liquid containing microcapsules having an average particle diameter of 0.7 $\mu$m was prepared.

Preparation of a Dispersion of Color Developers 7 g of the color developer represented by the structural formula (a) given below, 9 g of the color developer represented by the structural formula (b) given below, 9 g of the color developer represented by the structural formula (c) given below, 2 g of the color developer represented by the structural formula (d) given below, and 2 g of the color developer represented by the structural formula (e) given below were dispersed in 120 g of a 5% by weight aqueous solution of polyvinyl alcohol (Z210 manufactured by Nippon Synthetic Chemical Industry Co., Ltd.) by means of a Dyno mill manufactured by Shinmaru Enterprise Corp. to prepare a dispersion of fine particles. In this way, a dispersion of color developers having an average particle diameter of 0.45 $\mu$m was prepared (the average particle diameter was measured using an LA500 manufactured by Horiba Co., Ltd.).

(a)

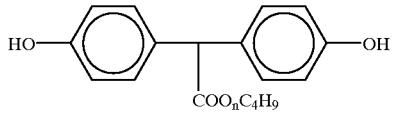

(b)

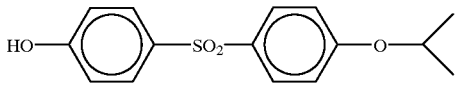

-continued (c)

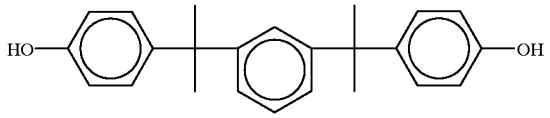

(d)

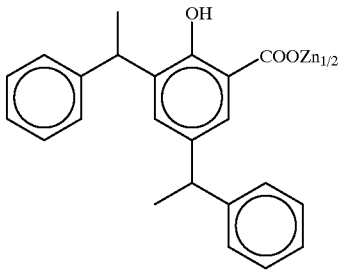

(e)

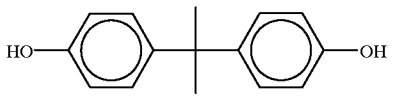

The color developer represented by the structural formula (e) is a water-soluble color developer, and the color developer represented by the structural formula (d) is a color developer having amorphous characteristics.

Preparation of a Heat-Sensitive Material 5.0 g of the above-described capsule liquid, 10.0 g of the dispersion of color developers, and 5.0 g of water were mixed together to prepare a coating liquid. The coating liquid was coated on one side of a 75 $\mu$m thick transparent substrate made from polyethylene terephthalate so that the solids of the coating were 15 g/m$^2$, and thereafter the coating was dried to form a heat-sensitive layer.

Preparation of a Protective Layer

A protective layer having the following composition in terms of solids was prepared at a coated weight of solids of 2.5 g/m$^2$ on the heat-sensitive layer.

| | Parts by weight |
|---|---|
| Polyvinyl alcohol (PVA124 manufactured by Kuraray Co., Ltd.) | 2 |
| Aluminum hydroxide (Hydilite H42S manufactured by Showa Denko Co., Ltd.) | 3 |
| Zinc stearate emulsion (Hydrin F115 manufactured by Chukyo Yushi Co., Ltd.) | 0.2 |
| Surfactant (Megafac F120 manufactured by Dainippon Ink & Chemicals Inc.) | 0.1 |

Example 2

Preparation of a Capsule Liquid 31 g of 2-anilino-3-methyl-6-N-ethyl-N-sec-butylaminofluoran, 3.1 g of 3,3-bis(1-octyl-2-methylindole-3-il)phthalide, and 1.2 g of Tinuvin P (manufactured by Ciba-Geigy Corp.) were dissolved in 40 g of ethyl acetate. The solution was admixed with 27 g of Takenate D-110N (manufactured by Takeda Chemical Industries, Ltd.). The resulting solution was mixed with 112 g of a 6% by weight aqueous solution of polyvinyl alcohol (PVA217E manufactured by Kuraray Co., Ltd.), and thereafter the mixture was emulsified at a revolution of 8,000 rpm for 5 minutes by means of an Ace Homogenizer (manufactured by Nippon Seiki Co., Ltd.). The emulsion thus obtained was admixed with 142 g of water and 1.0 g of tetraethylenepentamine, and thereafter allowed to react for 3 hours at 40° C. In this way, a capsule liquid containing microcapsules having an average particle diameter of 0.9 $\mu$m was prepared.

Preparation of a Dispersion of Color Developers 10 g of the color developer represented by the structural formula (c) given previously, 3 g of the color developer represented by the structural formula (d) given previously, 3 g of the color developer represented by the structural formula (e) given previously, and 10 g of the color developer represented by the structural formula (f) given below were dispersed in 120 g of a 6% by weight aqueous solution of polyvinyl alcohol (PVA205 manufactured by Kuraray Co., Ltd.) using an means of a Dyno mill manufactured by Shinmaru Enterprise Corp. to prepare a dispersion of fine particles. In this way, a dispersion of color developers having an average particle diameter of 0.49 $\mu$m was prepared (the average particle diameter was measured using an LA500 manufactured by Horiba Co., Ltd.).

(f)

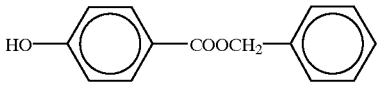

The color developer represented by the structural formula (e) is a water-soluble color developer, and the color developer represented by the structural formula (d) is a color developer having amorphous characteristics.

By using the capsule liquid and the dispersion of color developers, a heat-sensitive recording material was prepared as in Example 1.

Example 3

Preparation of a Capsule Liquid 14 g of 2-anilino-3-methyl-6-N-ethyl-N-sec-butylaminofluoran and 10 g of Takenate D-110N (manufactured by Takeda Chemical Industries, Ltd.) were dissolved in 20 g of ethyl acetate. The resulting solution was mixed with 112 g of 8% by weight aqueous solution of phthalated gelatin and 2 g of a 2% by weight aqueous solution of sodium dodecylbenzenesulfonate as an emulsifying surfactant and thereafter the mixture was emulsified at a revolution of 8,000 rpm for 5 minutes by means of an Ace Homogenizer (manufactured by Nippon Seiki Co., Ltd.). The emulsion thus obtained was admixed with 120 g of water and 0.6 g of tetraethylenepentamine, and thereafter allowed to react for 3 hours at 40° C. In this way, a capsule liquid containing microcapsules having an average particle diameter of 0.4 $\mu$m was prepared.

Preparation of a Dispersion of Color Developers 7 g of the color developer represented by the structural formula (c) given previously, 2 g of the color developer represented by the structural formula (d) given previously, 3 g of the color developer represented by the structural formula (e) given previously, 7 g of the color developer represented by the structural formula (g) given below, and 7 g of the color developer represented by the structural formula (h) given below were dispersed in 120 g of 8% by weight aqueous solution of phthalated gelatin by means of a Dyno mill manufactured by Shinmaru Enterprise Corp. to prepare a dispersion of fine particles. In this way, a dispersion of color developers having an average particle diameter of 0.42 μm was prepared (the average particle diameter was measured by LA500 manufactured by Horiba Co., Ltd.).

(g)

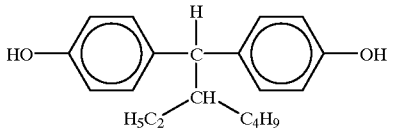

(h)

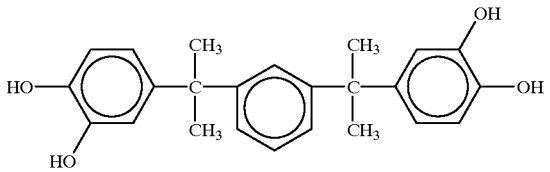

The color developer represented by the structural formula (e) is a water-soluable color developer, and the color developer represented by the structural formula (d) is a color developer having amorphous characteristics.

By using the capsule liquid and the dispersion of color developers, a heat-sensitive recording material was prepared as in Example 1.

Comparative Example 1

In order to prepare a dispersion of color developers, the procedure of Example 1 was repeated, except that the color developer (d) (amorphous color developer) was not used. The dispersion of color developers thus prepared had an average particle diameter of 0.43 μm (the average particle diameter was measured using an LA500 manufactured by Horiba Co., Ltd.). By using this dispersion of color developers, a heat-sensitive recording material was prepared as in Example 1.

Comparative Example 2

In order to prepare a dispersion of color developers, the procedure of Example 2 was repeated, except that the color developer (e) (water-soluble color developer) was not used. The dispersion of color developers thus prepared had an average particle diameter of 0.47 μm (the average particle diameter was measured using an LA500 manufactured by Horiba Co., Ltd.). By using this dispersion of color developers, a heat-sensitive recording material was prepared as in Example 1.

Comparative Example 3

In order to prepare a dispersion of color developers, the procedure of Example 8 was repeated, except that the color developers (d) and (e) were not used. The dispersion of color developers thus prepared had an average particle diameter of 0.44 μm (the average particle diameter was measured by LA500 manufactured using an Horiba Co., Ltd.). By using this dispersion of color developers, a heat-sensitive recording material was prepared as in Example 1.

Comparative Example 4

In order to prepare a dispersion of color developers, the procedure of Example 1 was repeated, except that the color developers (d) and (e) were not used. The dispersion of color developers thus prepared had an average particle diameter of 0.42 μm (the average particle diameter was measured using an LA500 manufactured by Horiba Co., Ltd.). By using this dispersion of color developers, a heat-sensitive recording material was prepared as in Example 1.

Comparative Example 5

5.0 g of the capsule liquid of Example 1, 10.0 g of the dispersion of color developers of Example 5, 10.0 g of a 8% by weight aqueous solution of polyvinyl alcohol (PVA205 manufactured by Kuraray Co., Ltd.) , and 5.0 g of water were mixed together to prepare a coating liquid, which was coated on one side of a 75 μm thick transparent substrate made from polyethylene terephthalate so that the solids of the coating were 18 g/m$^2$ and thereafter the coating was dried to form a heat-sensitive layer. Then, a protective layer was formed as in Example 1.

The transparency of the heat-sensitive recording materials prepared in Examples 1 to 3 and Comparative Examples 1 to 5 was measured by a haze meter manufactured by Suga Test Instruments Co., Ltd. In addition, by using a thermal head having a resistance of 1979Ω (manufactured by Kyocera Corp.) and recording energy per unit area of 40 mJ/mm$^2$ or 55 mJ/mm2, color was developed. The transmission density of the color was measured by means of a transmission densitometer TD904 manufactured by Macbeth Corp. The results are shown in Table 1.

TABLE 1

| | | Transmission density | |
|---|---|---|---|
| | Haze (%) | 40 mj | 55 mj |
| Example 1 | 35 | 1.2 | 2.2 |
| Example 2 | 39 | 1.4 | 2.4 |
| Example 3 | 31 | 1.1 | 2.0 |
| Comparative Example 1 | 65 | 1.0 | 1.9 |
| Comparative Example 2 | 71 | 1.1 | 2.1 |
| Comparative Example 3 | 81 | 0.9 | 1.7 |
| Comparative Example 4 | 75 | 1.1 | 2.0 |
| Comparative Example 5 | 44 | 0.4 | 1.1 |

From Table 1, it can be seen that the heat-sensitive recording materials of the present invention have a higher level of density of color formed and are superior in transparency. The heat-sensitive recording materials of the Comparative Examples were inferior in transparency.

As stated above, the present invention provides a heat-sensitive recording material which has superior transparency and a high level of color forming sensitivity.

What is claimed is:

1. A recording material having at least one heat-sensitive recording layer together with at least one protective layer supported by a substrate, said heat-sensitive recording layer being formed by a coating liquid containing:

a colorless or light-colored electron-donative dye precursor which is contained inside microcapsules; and solid particles which comprise a water-soluble polymer and a color developer, wherein the solid particles contained in the heat-sensitive layer are present as a dispersion and have particle diameters in the range of from 0.3 to 0.5 μm, and the haze of the heat-sensitive recording material is 55% or less.

2. A heat-sensitive recording material according to claim 1, wherein the dispersion contains at least 3 types of color developers with at least one of the color developers being a water-soluble color developer and at least one of the other color developers being a color developer having amorphous characteristics.

3. A heat-sensitive recording material according to claim 2, wherein the water-soluble color developer is a compound represented by the following general formula (I) and the color developer having amorphous characteristics is a compound represented by the following general formula (II), General formula (I):

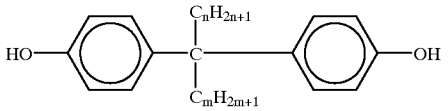

where m is an integer between 0 to 2 and n is an integer between 2 to 11,

General formula (II):

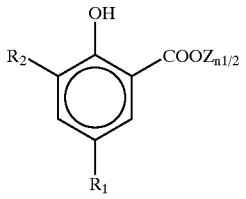

where $R_1$ and $R_2$ each represent an alkyl group having 1 to 10 carbon atoms or a group given below where $R_3$ represents a hydrogen atom or a methyl group.

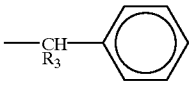

4. A heat-sensitive recording material according to claim 1, wherein the water-soluble polymer is at least one substance selected from the group consisting of partially saponified polyvinyl alcohol and gelatin.

5. A heat-sensitive recording material according to claim 2, wherein the water-soluble polymer is at least one substance selected from the group consisting of partially saponified polyvinyl alcohol and gelatin.

6. A heat-sensitive recording material according to claim 3, wherein the water-soluble polymer is at least one substance selected from the group consisting of partially saponified polyvinyl alcohol and gelatin.

7. A heat-sensitive recording material according to claim 1, wherein the colorless or light-colored electron-donative dye precursor is a compound represented by the following general formula (III)

General formula (III):

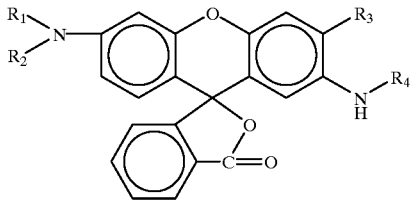

where $R_1$ represents an alkyl group having 1 to 8 carbon atoms; $R_2$ represents an alkyl or alkoxy group having 4 to 18 carbon atoms or a tetrahydrofurfuryl group; $R_3$ represents a hydrogen atom, an alkyl group having 1 to 15 carbon atoms, or a halogen atom; and $R_4$ represents a substituted or unsubstituted aryl group having 6 to 20 carbon atoms.

8. A heat-sensitive recording material according to claim 7, wherein the colorless or light-colored electron-donative dye precursor is included inside a microcapsule having a wall made from at least one polymeric material selected from the group consisting of polyurethane, polyurea, polyamide, polyester, polycarbonate, a urea/formamide resin, a melamine resin, polystyrene, a styrene/methacrylate copolymer, gelatin, polyvinylpyrrolidone, and polyvinyl alcohol.

* * * * *